US009995040B2

(12) United States Patent
Stahl, Jr. et al.

(10) Patent No.: US 9,995,040 B2
(45) Date of Patent: Jun. 12, 2018

(54) HEAD-OF-WALL FIRESTOPPING CONSTRUCTION FOR USE WITH AN ACOUSTIC WALL CONSTRUCTION

(71) Applicant: Specified Technologies Inc., Somerville, NJ (US)

(72) Inventors: James P. Stahl, Jr., Princeton, NJ (US); Julio Lopes, Dunellen, NJ (US); Paul Gandolfo, Doylestown, PA (US)

(73) Assignee: Specified Technologies, Inc., Somerville, NJ (US)

( * ) Notice: Subject to any disclaimer, the term of this patent is extended or adjusted under 35 U.S.C. 154(b) by 0 days. days.

(21) Appl. No.: 14/713,118

(22) Filed: May 15, 2015

(65) Prior Publication Data

US 2015/0354210 A1 Dec. 10, 2015

Related U.S. Application Data

(60) Provisional application No. 61/996,866, filed on May 16, 2014.

(51) Int. Cl.
*E04B 2/82* (2006.01)
*E04B 2/74* (2006.01)

(52) U.S. Cl.
CPC ..... *E04B 2/825* (2013.01); *E04B 2/7409* (2013.01)

(58) Field of Classification Search
CPC ..... E04B 2/825; E04B 2/7409
USPC ..... 52/232
See application file for complete search history.

(56) References Cited

U.S. PATENT DOCUMENTS

| | | | | |
|---|---|---|---|---|
| 3,286,420 | A * | 11/1966 | Lewis | E04B 2/82 52/241 |
| 5,010,702 | A | 4/1991 | Daw et al. | |
| 5,127,203 | A | 7/1992 | Paquette | |
| 5,755,066 | A | 5/1998 | Becker | |
| 5,913,788 | A | 6/1999 | Herren | |
| 5,921,041 | A | 7/1999 | Egri, II | |
| 5,950,385 | A | 9/1999 | Herren | |
| 6,058,668 | A | 5/2000 | Herren | |
| 6,176,053 | B1 | 1/2001 | St. Germain | |
| 7,043,880 | B2 | 5/2006 | Morgan et al. | |

(Continued)

*Primary Examiner* — Phi D A
*Assistant Examiner* — Omar F Hijaz
(74) *Attorney, Agent, or Firm* — Fox Rothschild LLP; Robert J. Sacco; Carol E. Thorstad-Forsyth

(57) ABSTRACT

A sealing gasket assembly for sealing a head-of-wall of an acoustic wall construction. The acoustic wall construction includes a ceiling track, having a given width, secured relative to a floor underside and supporting a plurality of studs with each of the studs including a stud face. At least one wall panel is secured spaced from and not in contact with the stud faces such that a spacing zone is defined between the stud faces and an inner surface of the at least one wall panel. The gasket assembly includes an insulating gasket configured for a main section thereof to be positioned between the ceiling track and floor underside, the main section defining first and second lateral sides which are spaced from one another a distance at least equal to the given width. A secondary gasket is associated with the insulating gasket and includes a sealing member extending outwardly relative to the first lateral side and configured to engage an upper portion of the at least one wall panel and a portion of the floor underside and form a seal between the at least one wall and the floor underside.

10 Claims, 6 Drawing Sheets

(56) References Cited

U.S. PATENT DOCUMENTS 7,152,385 B2 12/2006 Morgan et al.
7,240,905 B1 * 7/2007 Stahl, Sr. ..... E04B 1/681 277/652
7,617,643 B2 11/2009 Pilz et al.
7,681,365 B2 3/2010 Klein
7,735,295 B2 * 6/2010 Surowiecki ..... E04B 2/821 52/241
7,752,817 B2 7/2010 Pilz et al.
7,814,718 B2 10/2010 Klein
7,866,108 B2 1/2011 Klein
7,950,198 B2 5/2011 Pilz et al.
8,056,293 B2 11/2011 Klein
8,087,205 B2 1/2012 Pilz et al.
8,132,376 B2 3/2012 Pilz et al.
8,181,404 B2 5/2012 Klein
8,281,552 B2 10/2012 Pilz et al.
8,298,967 B2 10/2012 Egan et al.
8,316,605 B2 11/2012 Oberg
8,499,512 B2 8/2013 Pilz et al.
8,555,566 B2 * 10/2013 Pilz ..... E04B 2/828 52/167.1
8,590,231 B2 11/2013 Pilz
8,595,999 B1 12/2013 Pilz et al.
8,640,415 B2 2/2014 Pilz et al.
8,671,632 B2 3/2014 Pilz et al.
9,045,899 B2 * 6/2015 Pilz ..... E04B 2/7411
2004/0045234 A1 * 3/2004 Morgan ..... E04B 2/7411 52/232
2005/0138878 A1 * 6/2005 Becker ..... E04B 2/825 52/506.01
2009/0178363 A1 7/2009 Pilz et al.
2009/0223159 A1 9/2009 Colon
2011/0011019 A1 1/2011 Stahl, Jr. et al.
2011/0113709 A1 5/2011 Pilz et al.
2011/0185656 A1 8/2011 Klein
2011/0214371 A1 9/2011 Klein
2011/0247281 A1 10/2011 Pilz et al.
2013/0008104 A1 1/2013 Caboni
2013/0034683 A1 2/2013 Kramer et al.
2013/0074432 A1 3/2013 Ciuperca
2013/0118102 A1 * 5/2013 Pilz ..... E04B 1/948 52/232
2013/0205694 A1 * 8/2013 Stahl, Jr. ..... E04B 1/941 52/232

* cited by examiner

HEAD-OF-WALL FIRESTOPPING CONSTRUCTION FOR USE WITH AN ACOUSTIC WALL CONSTRUCTION

This application claims the benefit of U.S. Provisional Application No. 61/996,866, filed on May 16, 2014, the contents of which are incorporated herein by reference.

BACKGROUND OF THE INVENTION

1. Field of the Invention

The present invention applies generally to the field of head-of-wall insulation constructions and particularly those which are usable for providing firestopping insulating characteristics for an acoustical wall which is positioned with a defined space between the inner surface of the gypsum board and the outer surface of the structural wall studs by one or more of a plurality of intervening brackets therebetween. Such brackets can preferably be flexibly resilient and by being so resilient and by defining this intervening space will greatly decrease the acoustic transmission characteristics of the wall and provide significant acoustic insulation. The present invention provides a unique construction for a firestop insulating material construction usable with such acoustic walls which requires the sealing of the open space area between the innermost space of the gypsum board and the outermost space of the wall studs defined by the depth of the bracket positioned therebetween. Such brackets are commonly approximately 0.625" in height with this application and would yield an acoustic space in between the gypsum board and the sheetrock surface of approximately 0.625".

2. Description of the Prior Art

Various constructions have been shown for the purposes of head-of-wall firestopping insulations such as shown in U.S. Pat. No. 5,010,702 issued Apr. 30, 1991 to T. L. Daw et al and assigned to Daw Technologies, Inc. on a "Modular Wall System"; and U.S. Pat. No. 5,127,203 issued Jul. 7, 1992 to R. F. Paquette on a "Seismic/Fire Retardant Wall Structure And Method"; and U.S. Pat. No. 5,755,066 issued May 26, 1998 to D. W. Becker on a "Slip Track Assembly"; and U.S. Pat. No. 5,913,788 issued Jun. 22, 1999 to T. R. Herren on a "Fire Blocking And Seismic Resistant Wall Structure"; and U.S. Pat. No. 5,921,041 issued Jul. 13, 1999 to J. D. Egri, II on a "Bottom Track For Wall Assembly"; and U.S. Pat. No. 5,950,385 issued Sep. 14, 1999 to T. R. Herren on an "Interior Shaft Wall Construction"; and U.S. Pat. No. 6,058,668 issued May 9, 2000 to T. R. Herren on a "Seismic And Fire-Resistant Head-Of-Wall Structure"; and U.S. Pat. No. 6,176,053 issued Jan. 23, 2001 to R. C. A. St. Germain and assigned to Roger C. A. St. Germain on a "Wall Track Assembly And Method For Installing The Same"; and U.S. Pat. No. 7,043,880 issued May 16, 2006 to M. D. Morgan et al and assigned to W. R. Grace & Co.-Conn. on "In Situ Molded Thermal Barriers"; and U.S. Pat. No. 7,152,385 issued Dec. 26, 2006 to M. D. Morgan et al and assigned to W. R. Grace & Co.-Conn. on "In Situ Molded Thermal Barriers"; and U.S. Pat. No. 7,240,905 issued Jul. 10, 2007 to J. P. Stahl, Sr. and assigned to Specified Technologies Inc. on a "Method And Apparatus For Sealing A Joint Gap Between Two Independently Movable Structural Substrates"; and U.S. Pat. No. 7,617,643 issued Nov. 17, 2009 to D. A. Pilz et al and assigned to California Expanded Metal Products Company on a "Fire-Rated Wall Construction Product"; and U.S. Pat. No. 7,681,365 issued Mar. 23, 2010 to J. A. Klein on a "Head-Of-Wall Fireblock Systems And Related Wall Assemblies"; and U.S. Pat. No. 7,752,817 issued Jul. 13, 2010 to D. A Pilz et al and assigned to California Expanded Metal Products Company on a "Two-Piece Track System"; and U.S. Pat. No. 7,814,718 issued Oct. 19, 2010 to J. A. Klein on "Head-Of-Wall Fireblocks"; and U.S. Pat. No. 7,866,108 issued Jan. 11, 2011 to J. A. Klein on "Head-Of-Wall Fireblock Systems And Related Wall Assemblies"; and U.S. Pat. No. 7,950,198 issued May 31, 2011 to D. A. Pilz et al and assigned to California Expanded Metal Products Company on a "Fire-Rated Wall Construction Product"; and U.S. Pat. No. 8,056,293 issued Nov. 15, 2011 to J. A. Klein on "Head-Of-Wall Fireblock Systems And Related Wall Assemblies"; and U.S. Pat. No. 8,087,205 issued Jan. 2, 2012 to D. A. Pilz et al and assigned to California Expanded. Metal Products Company on a "Fire-Rated Wall Construction Product"; and U.S. Pat. No. 8,132,376 issued Mar. 13, 2012 to D. A. Pilz et al and assigned to California Expanded Metal Products Company on a "Two-Piece Track System"; and U.S. Pat. No. 8,1811, 404 issued May 22, 2012 to J. A. Klein on "Head-Of-Wall Fireblocks And Related Wall Assemblies"; and U.S. Pat. No. 8,281,552 issued Oct. 9, 2012 to D. A. Pilz et al and assigned to California Expanded Metal Products Company on an "Exterior Wall Construction Product"; and U.S. Pat. No. 8,298,967 issued Oct. 30, 2012 to W. F. Egan et al and assigned to BASF Corporation on an "Exterior Finishing System And Building Wall Containing A Corrosion-Resistant Enhanced Thickness Fabric"; and U.S. Pat. No. 8,316, 605 issued Nov. 27, 2012 to C. Oberg on an "insulated Metal Roofing And Wall Systems And Related Methods"; and U.S. Pat. No. 8,499,512 issued Aug. 6, 2013 to D. A. Pilz et al and assigned to California Expanded Metal Products Company on an "Exterior Wall Construction Product"; and U.S. Pat. No. 8,555,566 issued Oct. 15, 2013 to D. A. Pilz et al and assigned to California Expanded Metal Products Company on a "Two-Piece Track System"; and U.S. Pat. No. 8,590, 231 issued Nov. 26, 2013 to D. A. Pilz and assigned to California Expanded Metal Products Company on "Fire-Rated Joint System"; and U.S. Pat. No. 8,595,999 issued Dec. 3, 2013 to D. A. Pilz et al and assigned to California Expanded Metal Products Company on a "Fire-Rated Joint System"; and U.S. Pat. No. 8,640,415 issued Feb. 4, 2014 to D. A. Pilz et al and assigned to California Expanded Metal Products Company on a "Fire-Rated Wall Construction Products"; and U.S. Pat. No. 8,671,632 issued Mar. 18, 2014 to D. A. Pilz et al and assigned to California Expanded Metal Products Company on a "Wall Gap Fire Block Device, System And Method"; and U.S. Publication No. 2009/0178363 published Jul. 16, 2009 to D. A. Pilz and assigned to California Expanded Metal Products Company on an "Exterior Wall Construction Product"; and U.S. Publication No. 2009/0223159 published Sep. 10, 2009 to M. Colon on a "Firestop Block And Thermal Barrier System For Fluted Metal Decks"; and U.S. Publication No. 2011/0011019 published Jan. 20, 2011 to J. P. Stahl, Jr. et al and assigned to Specified Technologies Inc. on a "Firestopping Sealing Means For Use With Gypsum Wallboard In Head-Of-Wall Construction"; and U.S. Publication No. 2011/0113709 published May 19, 2011 to D. A. Pilz et al and assigned to California Expanded Metal Products Company on a "Wall Gap Fire Block Device, System And Method"; and U.S. Publication No. 2011/0185656 published Aug. 4, 2011 to J. A. Klein on a "Fire Retardant Cover For Fluted Roof Deck"; and U.S. Publication No. 2011/0214371 published Sep. 8, 2011 to J. A. Klein on an "Offset Leg Framing Element For Fire Stop Applications"; and U.S. Publication No. 2011/0247281 published Oct. 13, 2011 to D. A. Pilz et al and assigned to California Expanded Metal Products Company on a "Fire-Rated Wall Construction Product"; and U.S. Publication No. 2013/0008104 published Jan. 10, 2013 to M. Caboni on a "Building Construction For Making Transpirable Walls And Floors"; and U.S. Publication No. 2013/0034683 published Feb. 7, 2013 to H. Kramer et al on a "Foam Insulation Unit"; and U.S. Publication No. 2013/0074432 published Mar. 28, 2013 to R. I. Ciuperca on an "Insulated Concrete Form And Method Of Using Same".

SUMMARY OF THE INVENTION

In at least one embodiment, the present invention provides a sealing gasket assembly for sealing a head-of-wall of an acoustic wall construction. The acoustic wall construction includes a ceiling track, having a given width, secured relative to a floor underside and supporting a plurality of studs with each of the studs including a stud face. At least one wall panel is secured spaced from and not in contact with the stud faces such that a spacing zone is defined between the stud faces and an inner surface of the at least one wall panel. The gasket assembly includes an insulating gasket configured for a main section thereof to be positioned between the ceiling track and floor underside, the main section defining first and second lateral sides which are spaced from one another a distance at least equal to the given width. A secondary gasket is associated with the insulating gasket and includes a sealing member extending outwardly relative to the first lateral side and configured to engage an upper portion of the at least one wall panel and a portion of the floor underside and form a seal between the at least one wall and the floor underside.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
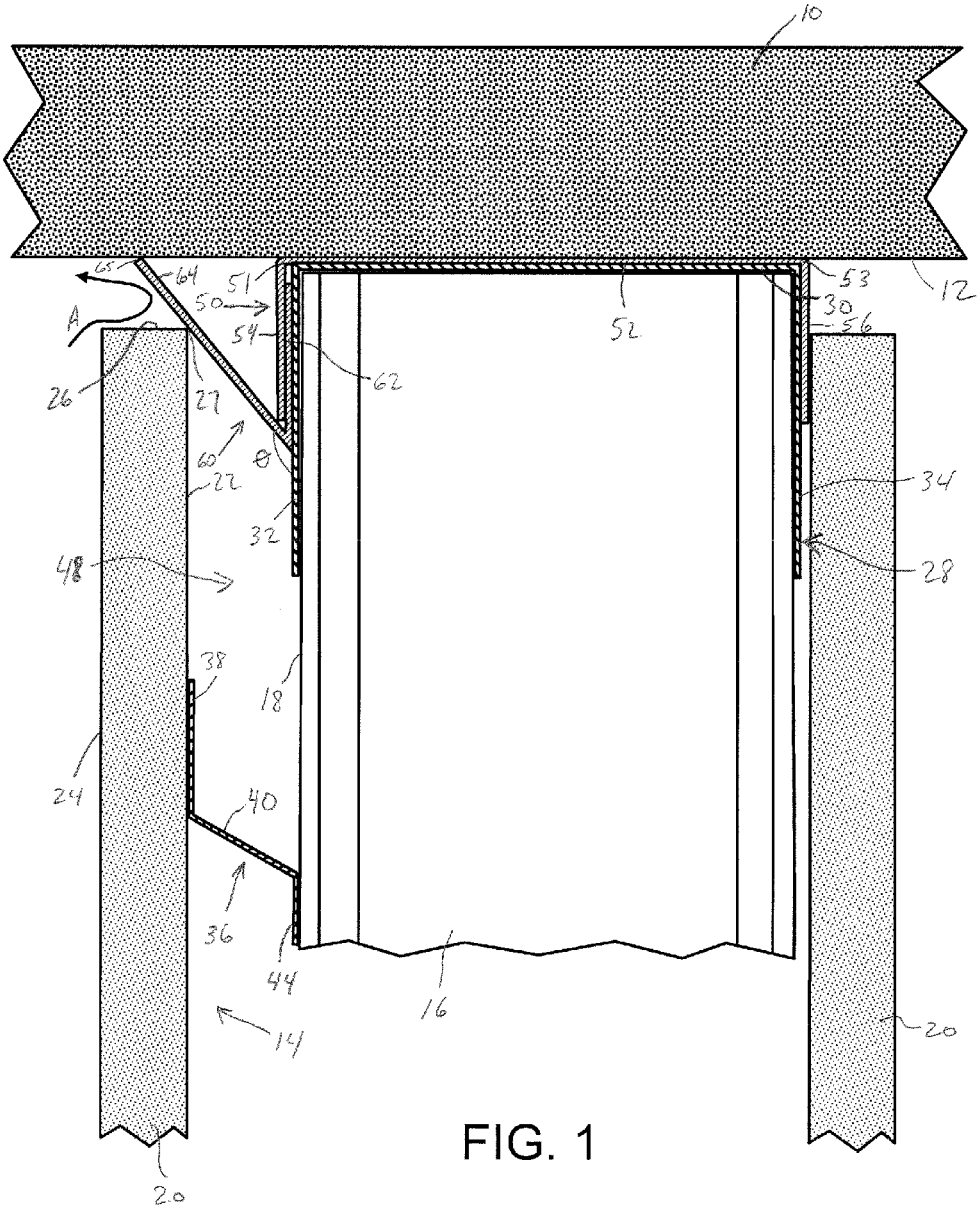
FIG. 1 is a side cross-sectional view of an exemplary head-of-wall firestopping construction in accordance with an embodiment of the present invention utilized with an acoustical wall construction.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

The head-of-wall firestopping construction of the present invention is for insulating against sound, noise, fire, heated gases, flames and/or smoke in the area below a floor construction 10 such as a concrete slab or the like and, particularly, below the floor undersurface 12 facing downwardly therefrom.

The present invention is particularly usable for positioning in those head-of-wall areas which are above an acoustic wall construction 14, as will be described with reference to FIGS. 1 and 2. Such acoustic wall constructions 14 include a plurality of studs 16 with stud faces 18 facing outwardly from the wall construction toward gypsum board 20 which is mounted on the exterior surface thereof. The gypsum board 20 includes an outer board surface 24 facing away from the stud and an inner board surface 22 facing toward the studs. In the acoustic wall configuration, brackets 36 are positioned between the gypsum board 20 and the stud face 18 such that the inner board surface 22 is spaced outwardly from the stud face 18. As such, a channel spacing zone 48 is defined between the face 18 of stud 16 and the inner board surface 22 of gypsum board 20. The spacing between the inner board surface 22 and the stud face 18 provides the acoustic dampening properties of the acoustic wall construction 14.

In the illustrated configuration, the channel bracket 36 includes a top channel member 38 which is adapted to abut the inner board surface 22 of the gypsum board wall panel 20. Each channel bracket 36 includes at least a first side channel member 40 extending from the top channel member 38 to a foot member 44. The foot member 44 is attachable to the face 18 of stud 16 for mounting thereon. Preferably, the first side channel member 40 extends in a slightly outwardly splayed direction such that the bracket 36 provides some flexibility to the wall panel 20. The invention is not limited to the illustrated channel bracket 36. For example, the channel bracket 36 may include an opposed side channel member with or without a second foot member. Furthermore, the invention is not limited to the illustrated form of spacing the wall panels 20 from the face 18 of the studs 16 and other spacers may be utilized.

The spacing created between the inner board surface 22 of board 20 and the face 18 of stud 16 creates additional areas that need to be insulated to achieve firestopping of the head-of-wall joint area.

The acoustic wall construction 14 utilizes a conventional construction for the ceiling track or steel runner channel 28. This ceiling track 28 includes a U-shaped channel with a main track section 30 from which first and second track side sections 32 and 34. The ceiling track 28 has a width W. The U-shaped channel is configured to receive and secure the tops of the studs 16 and in turn is connected to the underside 12 of the floor construction 10. As described hereinafter, a portion of the insulating gasket 50 in accordance with the invention is positioned between the ceiling track 28 and the floor underside 12, thereby providing insulation therebetween.

With continued reference to FIGS. 1 and 2, an insulating gasket 50 in accordance with an embodiment of the invention will be described. The insulating gasket 50 includes a main section 52 which extends between lateral side edges 51 and 53. The lateral side edges 51 and 53 are preferably spaced apart a distance at least as wide as the width W of the ceiling track 28 such that when the insulating gasket 50 is positioned relative to the ceiling track 28 as illustrated in FIG. 1, the lateral edges 51 and 53 will extend along or outwardly of the edges of the ceiling track 28. In the present embodiment, a first gasket side panel 54 extends downwardly from the first lateral edge 51 and a second gasket side panel 56 extends downwardly from the second lateral edge 53. With this configuration, this portion of the insulating gasket 50 has a U-shaped configuration which complements the configuration of the ceiling track 28 and the gasket side panels 54, 56 extend along the track side sections 32, 34, respectively. While the main section 52 is shown to be continuous between the side edges 51, 53, it is understood that the main section 52 may be formed in two or more separate sections, for example, for use with a wider ceiling track 28.

To seal the space created by the channel spacing zone 48, a secondary gasket 60 is utilized in conjunction with the insulating gasket 50. While the secondary gasket 60 is illustrated and described herein as a separate element positioned with the insulating gasket 50, it is recognized that the secondary gasket 60 and the insulating gasket 50 may be formed as a unitary structure. The secondary gasket 60 of the present embodiment includes a first leg 62 configured to extend along the inside surface of the first gasket side panel 54 and to be held between the side panel 54 and the track side section 32. A second leg 64 extends at an angle θ relative to the first leg 62, and the side panel 54, such that the second leg 64 extends across the channel spacing zone 48, with an intermediate area thereof sealing against the inner edge 27 of the upper end 26 of the wall panel 20. Furthermore, a free end 65 of the second leg 64 contacts the underside 12 of the floor construction 10. With the contact between the second leg 64 and the wall panel 20 and the floor underside 12, sound waves, smoke, fire or the like attempting to pass around the top of the wall panel 20 of the acoustical wall construction 14 will be suppressed as indicated by arrow A.

The insulating gasket 50 and the secondary gasket 60 can be made partially from a firestopping insulating material which could be an intumescent firestopping material. It also can be made solely or partially from an acoustical insulating material for applications where sound transmissions are found to be undesirable. Such acoustical insulating configurations can preferably be formed of a felt acoustically insulating material. It is also possible for the insulating and secondary gasket construction to have components of both firestopping and acoustical sealing therewithin and with such configurations firestopping can be provided by an intumescent component and acoustical sealing can be provided by a felt material all in the same construction.

Figure 2:
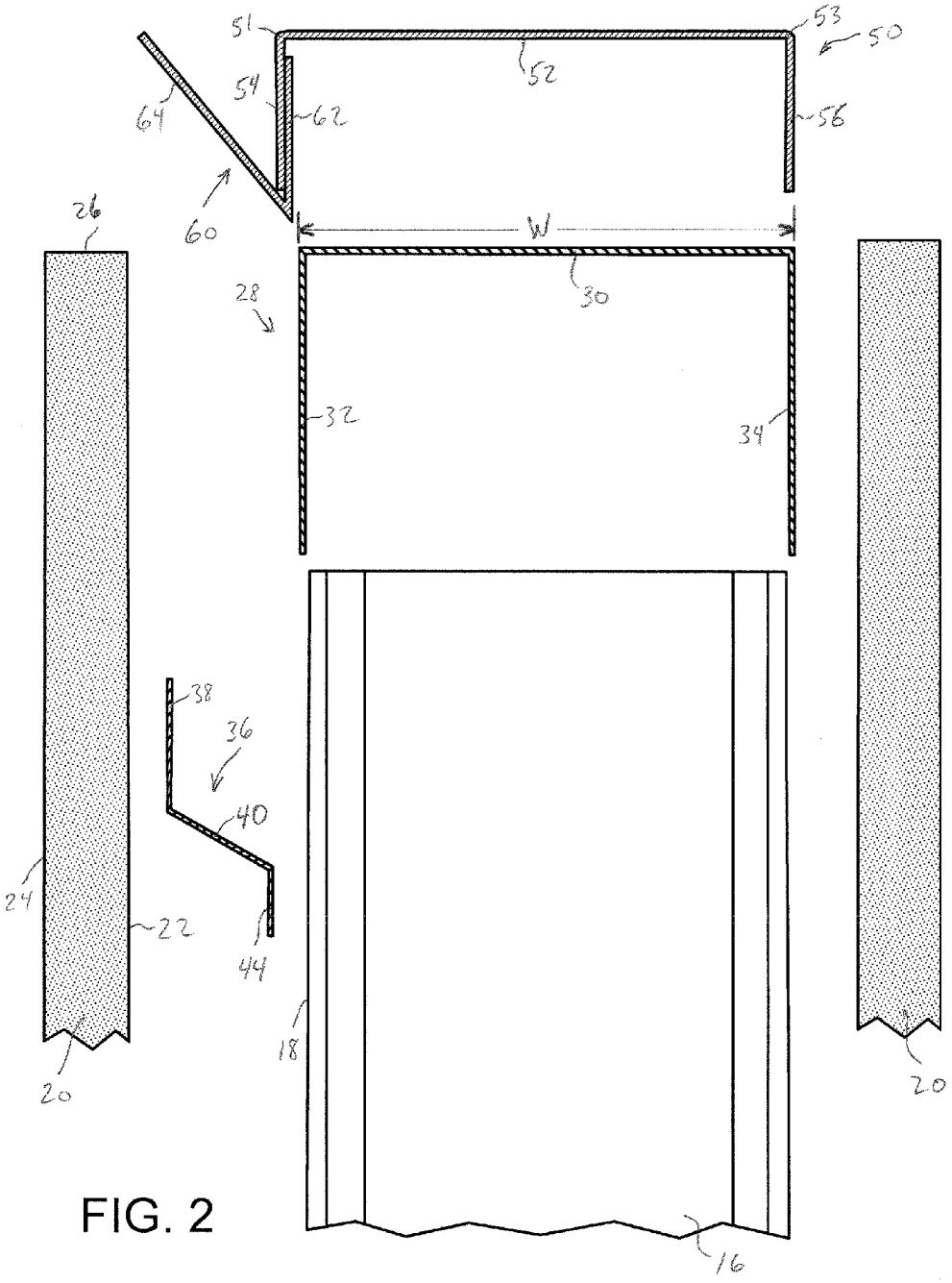
FIG. 2 is an exploded view head-of-wall firestopping construction of FIG. 1.
Figure 3:
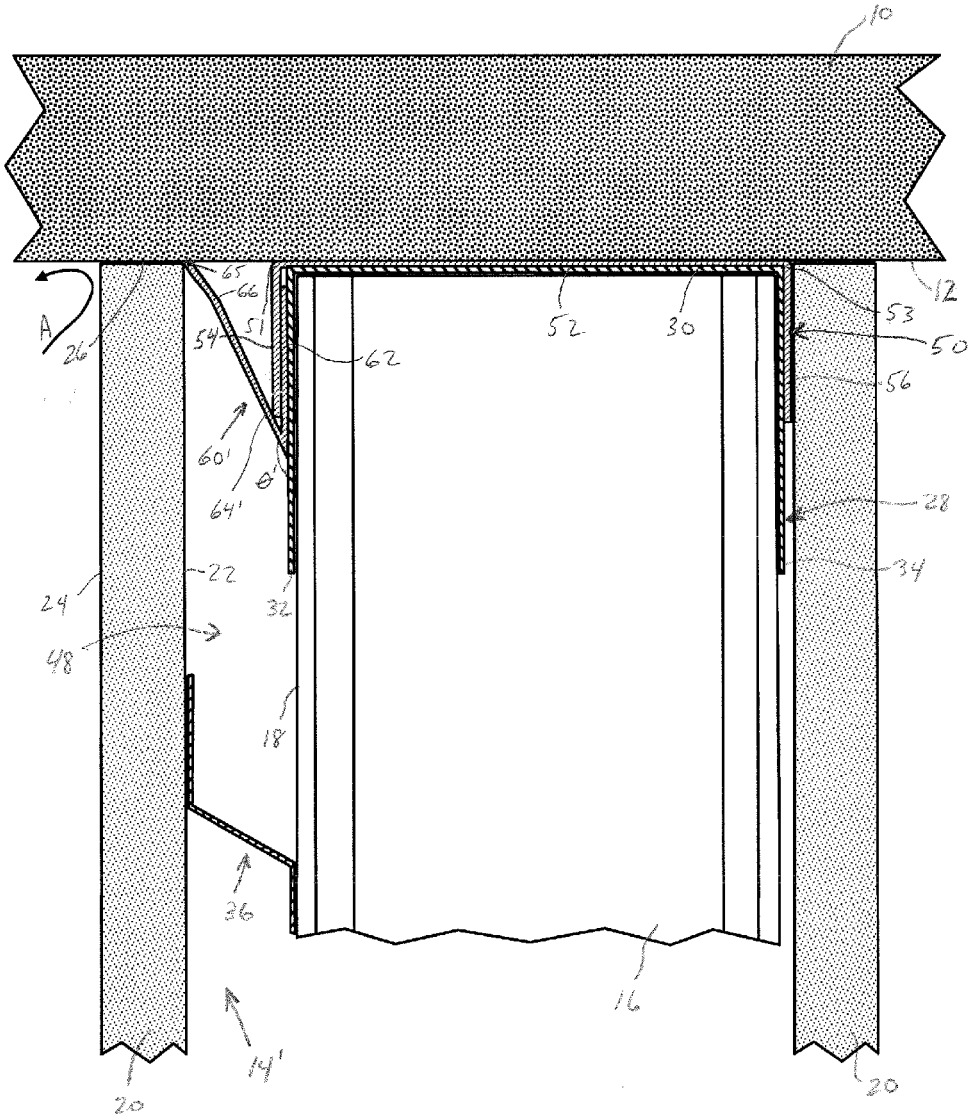
FIG. 3 is a side cross-sectional view of an exemplary head-of-wall firestopping construction in accordance with another embodiment of the present invention.

FIG. 3 illustrates a further embodiment of secondary gasket 60' of the present invention which is similar to that of the embodiment of FIG. 1. The secondary gasket 60' is configured for use in an acoustical wall construction 14' wherein the wall panels 20 are positioned with their upper board surface 26 in direct abutment with respect to the floor undersurface 12 of the floor construction 10. In this configuration the conventional construction for the insulating gasket 50 is included with a gasket upper panel 52 extending over the top channel member 38 and the first gasket side panel 54 extending over the first track side section 32 and the second gasket side panel 56 extending over the second track side section 34. The secondary gasket 60' of the present embodiment again includes a first leg 62 configured to extend along the inside surface of the first gasket side panel 54 and to be held between the side panel 54 and the track side section 32. The second leg 64' of the present secondary gasket 60' extends at an angle θ' relative to the first leg 62, and the side panel 54, with the angle θ' being greater than in the previous embodiment such that the second leg 64' extends within the channel spacing zone 48 with the free end 65 of the second leg 64' contacting the underside 12 of the floor construction 10 proximate to the upper board surface 26. The second leg 64' may have a bend 66 therein such that the free end 65 is directed toward the wall panel 20. With the contact between the second leg 64' and the floor underside 12, sound waves, smoke, fire or the like attempting to pass around the top of the wall panel 20 of the acoustical wall construction 14 will be suppressed as indicated by arrow A.

Figure 4:
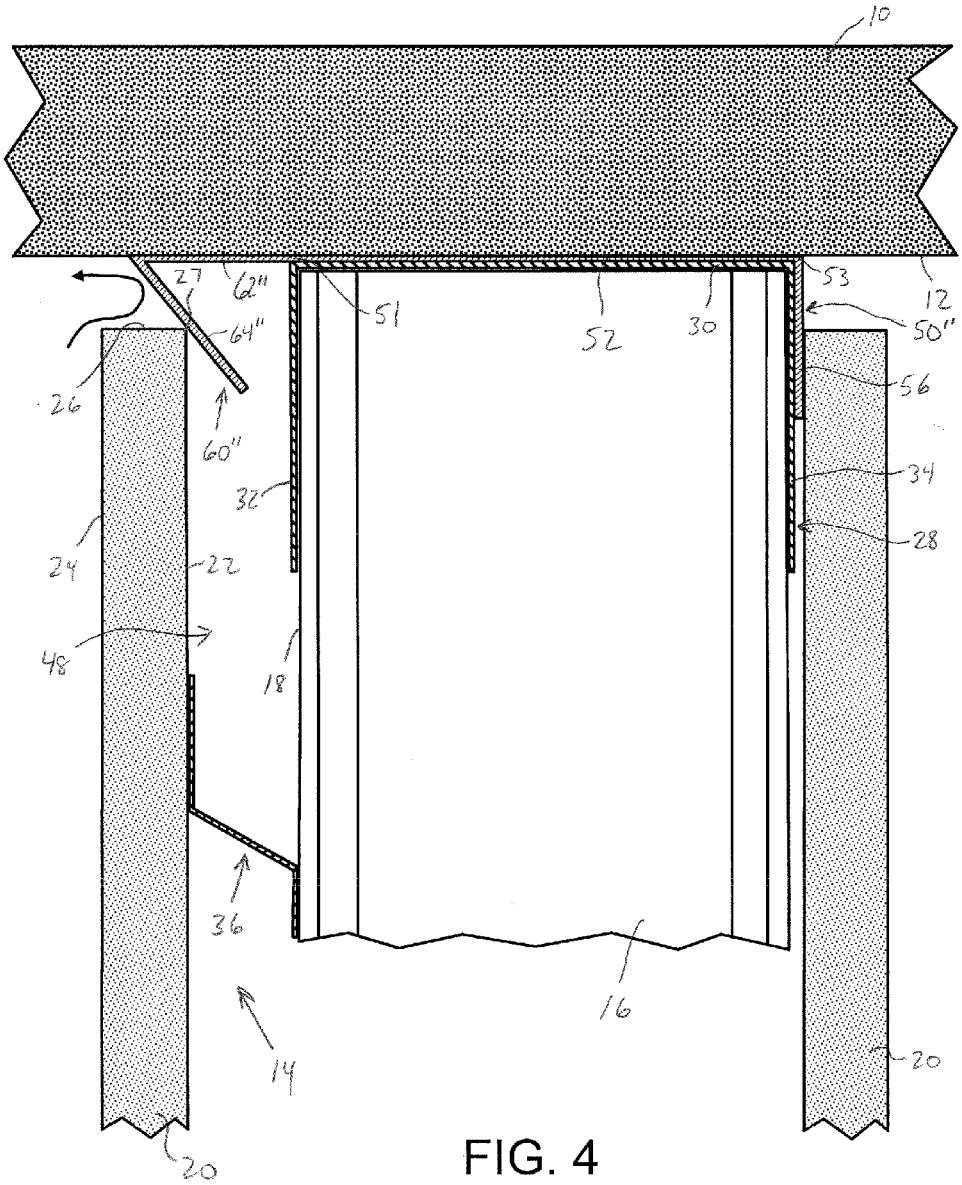
FIG. 4 is a side cross-sectional view of an exemplary head-of-wall firestopping construction in accordance with yet another embodiment of the present invention.

FIG. 4 illustrates an insulating gasket 50" in accordance with another alternative embodiment of this invention wherein the secondary gasket 60" is integrated therewith. In the present embodiment, the insulating gasket 50" includes a main section 52 and a gasket side panel 56 on the non-acoustical side of the wall, but the side panel on the side of the acoustical construction 14 is omitted. Instead, the secondary gasket 60" extends from the lateral edge 51 of the main section 52. In the present embodiment, a first leg 62" of the secondary gasket 60" extends from the lateral edge 51 substantially parallel to the main section 52. The first leg 62" extends a distance at least and preferably greater than the width of the channel spacing zone 48 such that the first leg 62" extends over at least a portion of the upper board surface 26. The second leg 64" extends at an inward angle from the first leg 62", the angle selected such that a portion of the second leg 64" seals against the inner edge 27 of the upper end 26 of the wall panel 20. With the contact between the second leg 64" and the wall panel 20 and the floor underside 12, sound waves, smoke, fire or the like attempting to pass around the top of the wall panel 20 of the acoustical wall construction 14 will be suppressed as indicated by arrow A.

Figure 5:
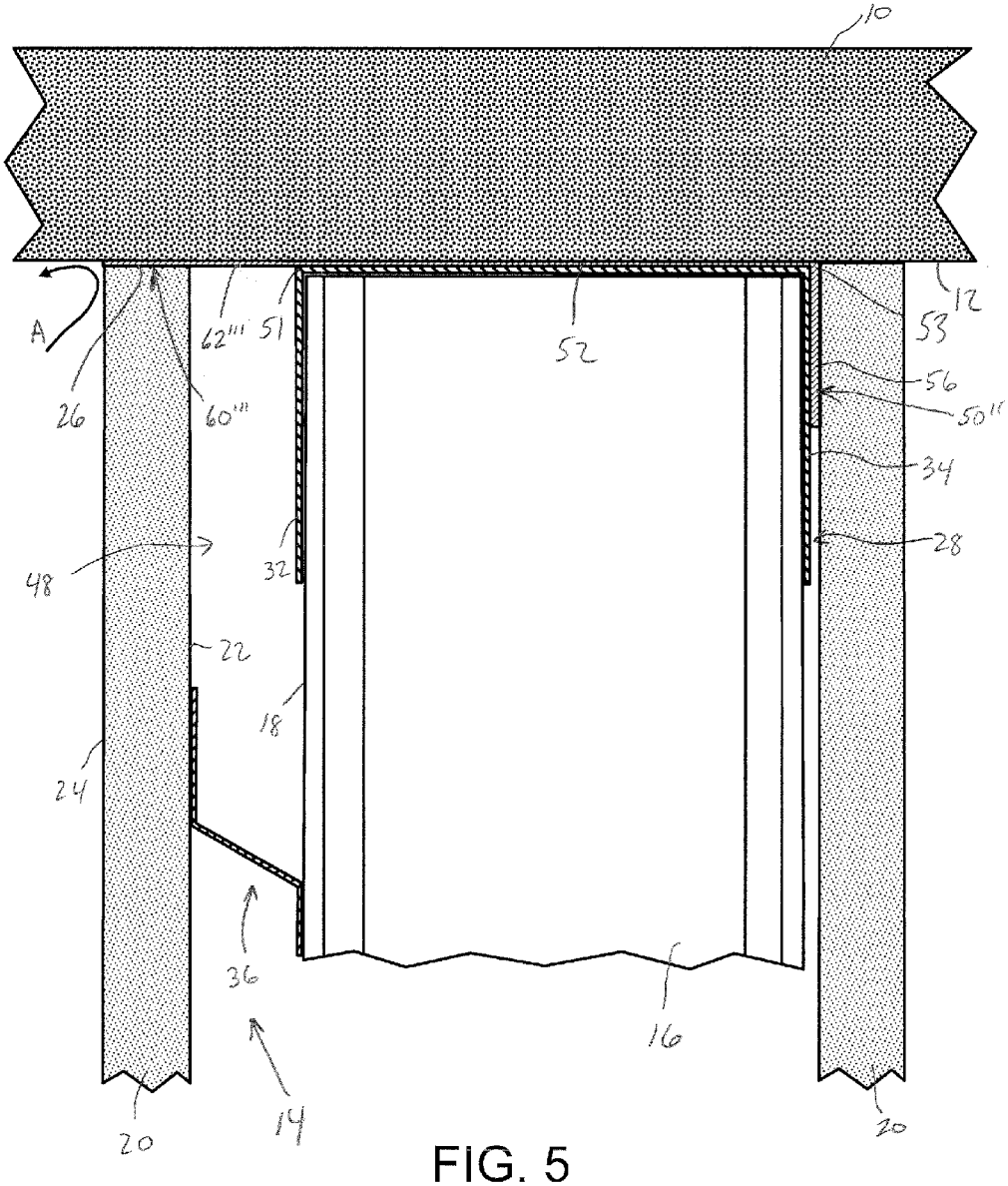
FIG. 5 is a side cross-sectional view of an exemplary head-of-wall firestopping construction in accordance with another embodiment of the present invention.

Referring to FIG. 5, an insulating gasket 50" and integrated secondary gasket 60''' in accordance with another alternative embodiment of the invention will be described. The secondary gasket 60''' of the present embodiment is configured for use in an acoustical wall construction 14' wherein the wall panels 20 are positioned with their upper board surface 26 in direct abutment with respect to the floor undersurface 12 of the floor construction 10. The insulating gasket 50" is the same as in the previous embodiment and includes a main section 52 and a gasket side panel 56 on the non-acoustical side of the wall. On the acoustical side of the wall, the secondary gasket 60''' extends from the lateral edge 51 of the main section 52. In the present embodiment, the secondary gasket includes a single leg 62''' which extends from the lateral edge 51 substantially parallel to the main section 52. The leg 62''' extends a distance at least equal to the width of the channel spacing zone 48 plus the width of the wall panel 20 such that the leg 62''' extends between the upper board surface 26 and the floor underside. With the contact between the leg 62''' and the wall panel 20 and the floor underside 12, sound waves, smoke, fire or the like attempting to pass around the top of the wall panel 20 of the acoustical wall construction 14 will be suppressed as indicated by arrow A.

Figure 6:
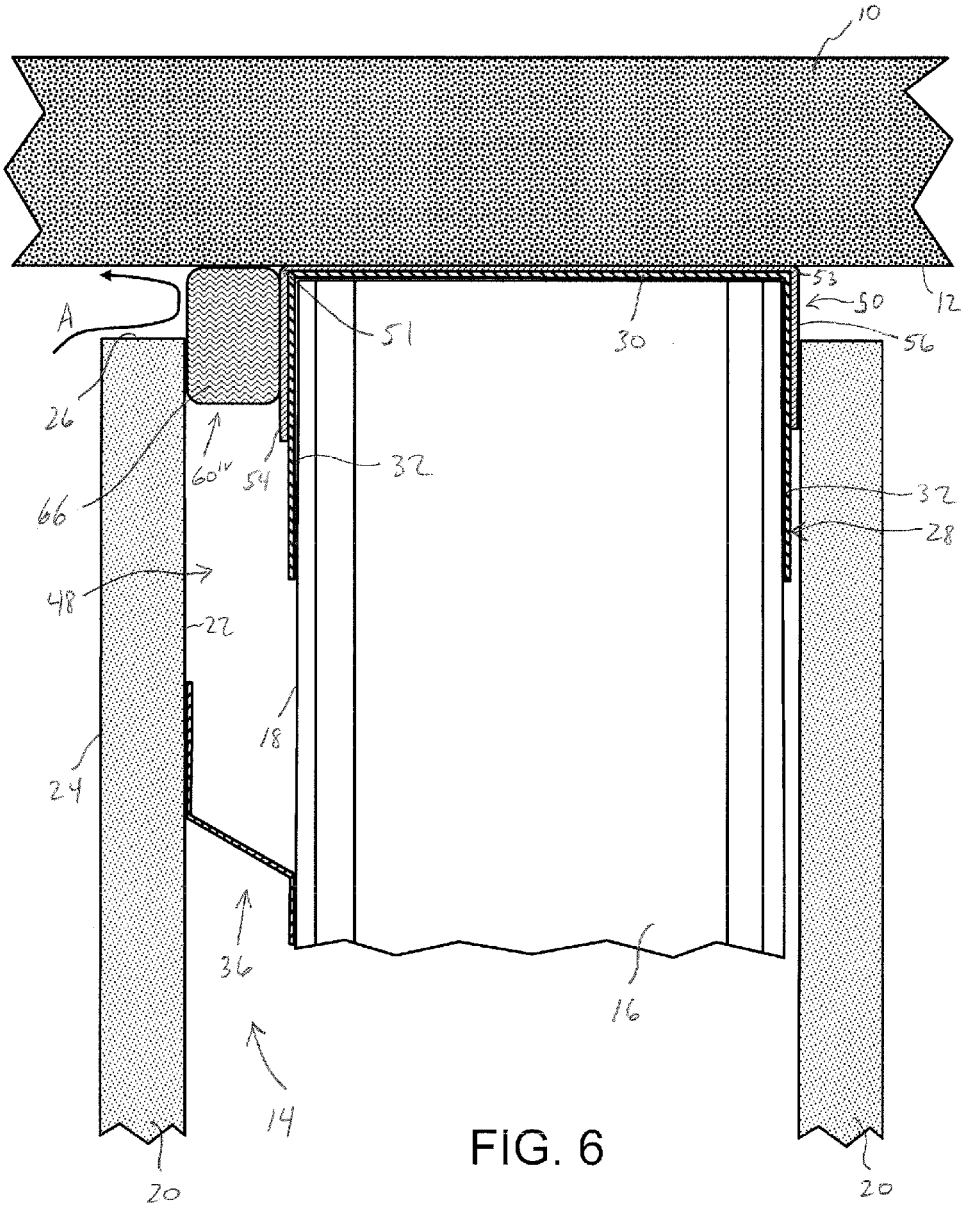
FIG. 6 is a side cross-sectional view of an exemplary head-of-wall firestopping construction in accordance with yet another embodiment of the present invention.

FIG. 6 illustrates an insulating gasket 50 and secondary gasket $\mathbf{60}^{iv}$ in accordance with another alternative embodiment of the present invention. In the present embodiment, the insulating gasket 50 is substantially the same as that described with respect to FIG. 1. In the present embodiment, the secondary gasket $\mathbf{60}^{iv}$ includes a gap filler member 66 in the form of a pillow or plug. The gap filler member 66 may be formed integrally with the gasket side panel 54 or may be attached thereto. The gap filler member 66 has a width equal or greater than the width of the channel spacing zone 48 such that the gap filler member 66 contacts the inner surface 22 of the wall panel 20, thereby sealing of the uppermost portion of this open area. With the contact between the gap filler member 66 and the wall panel 20 and the floor underside 12, sound waves, smoke, fire or the like attempting to pass around the top of the wall panel 20 of the acoustical wall construction 14 will be suppressed as indicated by arrow A.

The insulating gasket and the secondary gasket of the various embodiments can be made partially from a firestopping insulating material which could be an intumescent firestopping material. It also can be made solely or partially from an acoustical insulating material for applications where sound transmissions are found to be undesirable. Such acoustical insulating configurations can preferably be formed of a felt acoustically insulating material. It is also possible for the insulating and secondary gasket construction to have components of both firestopping and acoustical sealing therewithin and with such configurations firestopping can be provided by an intumescent component and acoustical sealing can be provided by a felt material all in the same construction.

It is noted that the wall illustrated in the various figures includes an acoustical construction on only one surface thereof (the left side of the figure) and a non-acoustical construction on the other side thereof (the right side of the figure), and therefore, only one secondary gasket is utilized. On the non-acoustical side, the wall panel 20 simply abuts the gasket side panel 56. However, if that side of the wall also had an acoustical construction, a second secondary gasket could be utilized to seal such construction. Such a second secondary gasket can again be manufactured as a separate component or be formed integral with the insulating gasket. In each embodiment, the secondary gasket includes a portion which extends outwardly relative to the respective lateral edge 51, 53 and contacts the wall panel and/or floor underside.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

What is claimed is:

1. A sealing gasket assembly for sealing a head-of-wall of an acoustic wall construction, the acoustic wall construction including a ceiling track, having a given width, secured relative to a floor underside and supporting a plurality of studs with each of the studs including a stud face and wherein at least one wall panel is secured spaced from and not in contact with the stud faces such that a spacing zone is defined between the stud faces and an inner surface of the at least one wall panel, the gasket assembly comprising:

an insulating gasket configured for a main section thereof to be positioned between the ceiling track and the floor underside, the main section defining a web extending along a horizontal plane and first and second lateral sides which are spaced from one another a distance at least equal to the given width;

a secondary gasket positioned adjacent to the insulating gasket and including a sealing member having a first leg and a second leg intersecting at an acute angle, with the second leg having a distal end extending diagonally outwardly away from the first lateral side, the distal end is configured to terminate at the horizontal plane, wherein the second leg is configured to engage an upper portion of the at least one wall panel and a portion of the floor underside so that the sealing member extends across the spacing zone and forms a seal between the inner surface of the at least one wall panel and the stud faces; wherein the insulating gasket includes a side gasket panel depending from each of the first and second lateral sides, each side gasket panel extending adjacent a respective track side section of the ceiling track; and wherein the sealing member first leg is positioned between the respective side gasket panel and the respective track side section and the second leg is extending from the first leg at an angle such that the second leg extends across the spacing zone.

2. The sealing gasket assembly according to claim 1 wherein the second leg extends such that an intermediate portion thereof engages an inner edge of an upper surface of the at least one wall panel and a free end of the second leg contacts the floor underside.

3. The sealing gasket assembly according to claim 1 wherein the second leg extends such that a free end thereof contacts the floor underside adjacent to a position wherein an upper surface of the at least one wall panel contacts the floor underside.

4. The sealing assembly according to claim 1 wherein the insulating gasket and the secondary gasket are made at least partially from a firestopping insulating material, an acoustical insulating material, or a combination thereof.

5. The sealing assembly according to claim 4 wherein the firestopping insulating material is an intumescent firestopping material.

6. The sealing assembly according to claim 4 wherein the acoustical insulating material is a felt acoustically insulating material.

7. The sealing gasket assembly according to claim 1 wherein the insulating gasket and the secondary gasket are formed as unitary construction.

8. The sealing gasket assembly according to claim 1 wherein the main section comprises at least two spaced apart sections.

9. The sealing gasket assembly according to claim 1 further comprising an additional secondary gasket associated with the insulating gasket and including a sealing member extending outwardly relative to the second lateral side.

10. A sealing gasket assembly for sealing a head-of-wall of an acoustic wall construction, the acoustic wall construction including a ceiling track, having a given width, secured relative to a floor underside and supporting a plurality of studs with each of the studs including a stud face and wherein at least one wall panel is secured spaced from and not in contact with the stud faces such that a spacing zone is defined between the stud faces and an inner surface of the at least one wall panel, the gasket assembly comprising:

an insulating gasket configured for a main section thereof to be positioned between the ceiling track and the floor underside, the main section defining a web extending along a horizontal plane and first and second lateral sides which are spaced from one another a distance at least equal to the given width, wherein the insulating gasket includes a side gasket panel depending from each of the first and second lateral sides, each side gasket panel extending adjacent a respective track side section of the ceiling track; and a secondary gasket positioned adjacent to the insulating gasket and including a sealing member having a first leg and a second leg intersecting at an acute angle, with the second leg having a distal end extending outwardly away from the first lateral side, the distal end is configured to terminate at the horizontal plane, wherein the second leg is configured to engage an upper portion of the at least one wall panel and a portion of the floor underside and form a seal between the at least one wall panel and the floor underside, wherein the first leg is positioned between a respective side gasket panel and a respective track side section and the second leg extends across the spacing zone such that an intermediate portion thereof engages an inner edge of an upper surface of the at least one wall panel and a free end of the second leg contacts the floor underside.

* * * * *